US007350491B2

(12) United States Patent
Stretch et al.

(10) Patent No.: US 7,350,491 B2
(45) Date of Patent: Apr. 1, 2008

(54) LASH ADJUSTER AND VALVE SYSTEM

(75) Inventors: Dale A. Stretch, Novi, MI (US); Christopher E. Hill, Mebane, NC (US); Edwin D. Lorenz, Grand Blanc, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/518,834

(22) Filed: Sep. 11, 2006

(65) Prior Publication Data

US 2007/0089698 A1 Apr. 26, 2007

Related U.S. Application Data

(60) Provisional application No. 60/729,709, filed on Oct. 24, 2005.

(51) Int. Cl.
*F01L 1/14* (2006.01)

(52) U.S. Cl. ..... 123/90.48; 123/90.15; 123/90.12; 123/90.16

(58) Field of Classification Search ..... 123/90.15, 123/90.12, 90.48, 90.16
See application file for complete search history.

(56) References Cited

U.S. PATENT DOCUMENTS

| | | | | |
|---|---|---|---|---|
| 3,140,698 | A | | 7/1964 | Voorhies |
| 3,938,483 | A | | 2/1976 | Firey |
| 4,009,694 | A | | 3/1977 | Firey |
| 4,373,477 | A | | 2/1983 | Buente et al. |
| 4,671,221 | A | | 6/1987 | Geringer et al. |
| 4,796,576 | A | * | 1/1989 | Matsuura et al. ..... 123/90.43 |
| 4,862,844 | A | | 9/1989 | Wakeman et al. |
| 4,972,761 | A | | 11/1990 | Thomsen et al. |
| 5,251,587 | A | | 10/1993 | Mori et al. |
| 5,640,934 | A | | 6/1997 | Mori et al. |
| 5,685,264 | A | * | 11/1997 | Allen et al. ..... 123/90.16 |
| 6,006,706 | A | * | 12/1999 | Kanzaki ..... 123/90.15 |
| 6,321,706 | B1 | | 11/2001 | Wing |
| 6,457,487 | B1 | | 10/2002 | Stephenson et al. |
| 6,477,997 | B1 | | 11/2002 | Wakeman |
| 6,655,349 | B1 | | 12/2003 | Cavanagh |
| 2005/0087716 | A1 | | 4/2005 | Udd |
| 2005/0205019 | A1 | | 9/2005 | Burk et al. |

* cited by examiner

*Primary Examiner*—Zelalem Eshete
(74) *Attorney, Agent, or Firm*—Honigman, Miller, Schwartz & Cohn LLP

(57) ABSTRACT

An added-motion hydraulic valve system is disclosed. The added-motion hydraulic valve system includes an engine valve actuator that causes movement of an engine valve, fluid that moves through a solenoid actuator valve, and a fluid actuator housing having a volume for receiving said fluid. The volume is disposed between the engine valve actuator and an engagement end of the engine valve. A lash adjuster assembly for a valve system is also disclosed. The lash adjuster assembly includes an actuator fluid housing and an added motion hydraulic lash adjuster disposed within the actuator fluid housing. According to an embodiment, the lash adjuster assembly includes a mechanical lash adjuster actuated by a cam arrangement.

29 Claims, 10 Drawing Sheets

LASH ADJUSTER AND VALVE SYSTEM

RELATED APPLICATION

This disclosure claims the benefit of Provisional Patent Application No. 60/729,709, filed on Oct. 24, 2005.

TECHNICAL FIELD

The present invention relates to a lash adjuster and system for controlling the movement of an engine valve of an internal combustion engine.

BACKGROUND

It is known in the art that a cam system, which may include, for example, a cam shaft and rocker arm, opens and closes a valve of an internal combustion (IC) engine. A standard cam profile engine valve opening/closing curve 300*a* is shown generally in FIG. 10 according to an embodiment.

It is also known in the art that the timing of engine valve closure during an IC engine's induction stroke may be varied to, among other things, optimize the performance of the IC engine. Known methods to achieve variable valve timing may include, for example, "lost motion" devices. A lost motion engine valve opening/closing curve is generally shown at 300*c* of FIG. 10. As illustrated, the lost motion curve 300*c* reduces (or may completely eliminate) the standard opening/closing stoke 300*a* of the engine valve.

However, there is often a desire to provide, among other things, a delayed, "added motion" closing stroke of an engine valve, which is shown generally at 300*b*. Fluid porting tolerances of a fluid actuator are stringently designed for controlling a delayed motion 301 and seating 302*b* of an engine valve along the added motion curve 300*b*. Due to, among other things, engine valve seating wear, the seating 302*b* may have undesirable performance variations, which are shown generally at 402. Such seating performance variations 402 may result from, for example, undesirable lash of an engine valve system.

A need therefore exists for providing an improved added-motion system and a lash adjustment mechanism and valve system that provides an expected seating performance as applied to, for example, an added motion engine valve.

BRIEF DESCRIPTION OF THE DRAWINGS

Embodiments of the disclosure will now be described, by way of example, with reference to the accompanying exemplary drawings, wherein.

DETAILED DESCRIPTION

Figure 1:
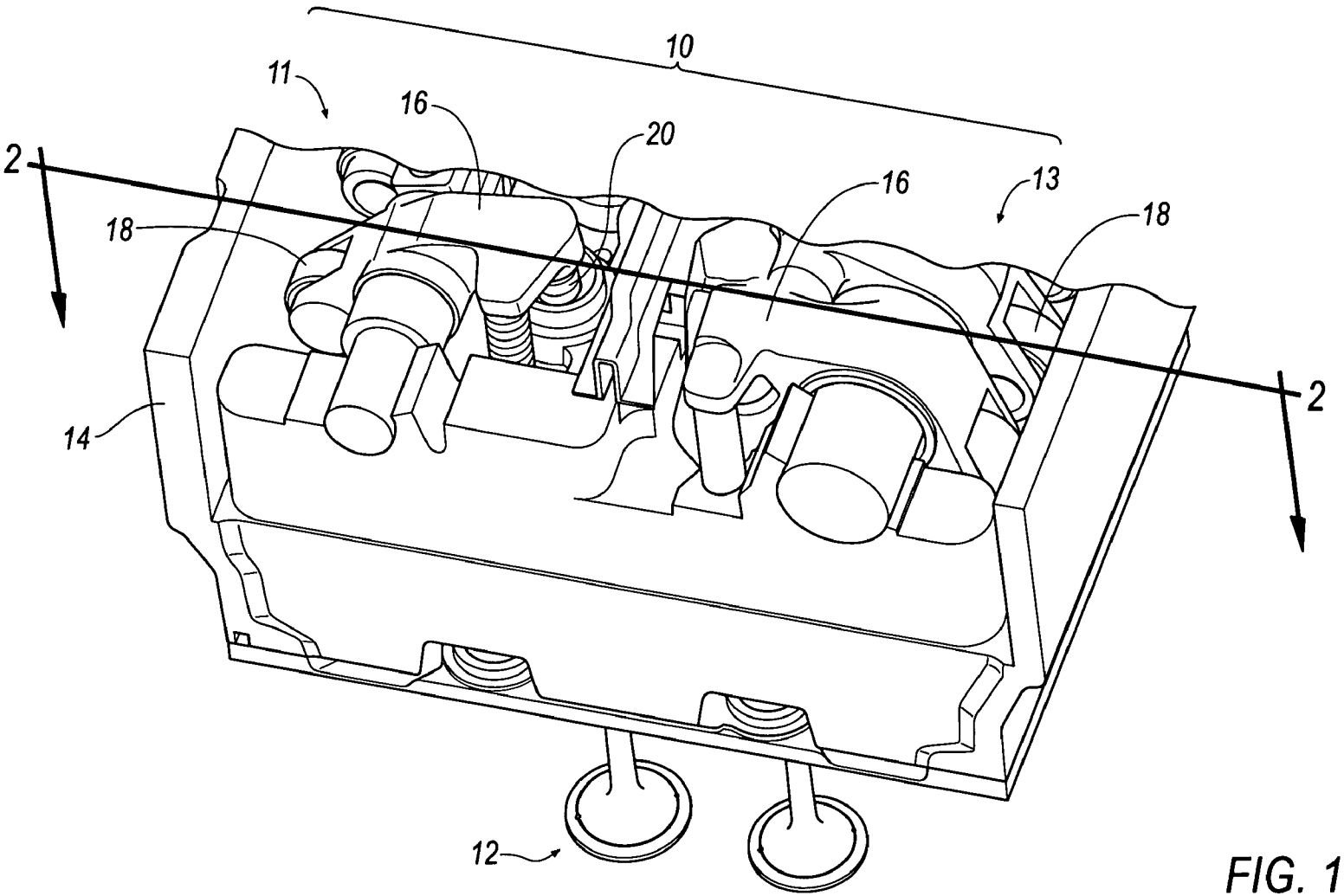
FIG. 1 is a partial top perspective view of a valve train and housing cradle according to an embodiment.
Figure 2:
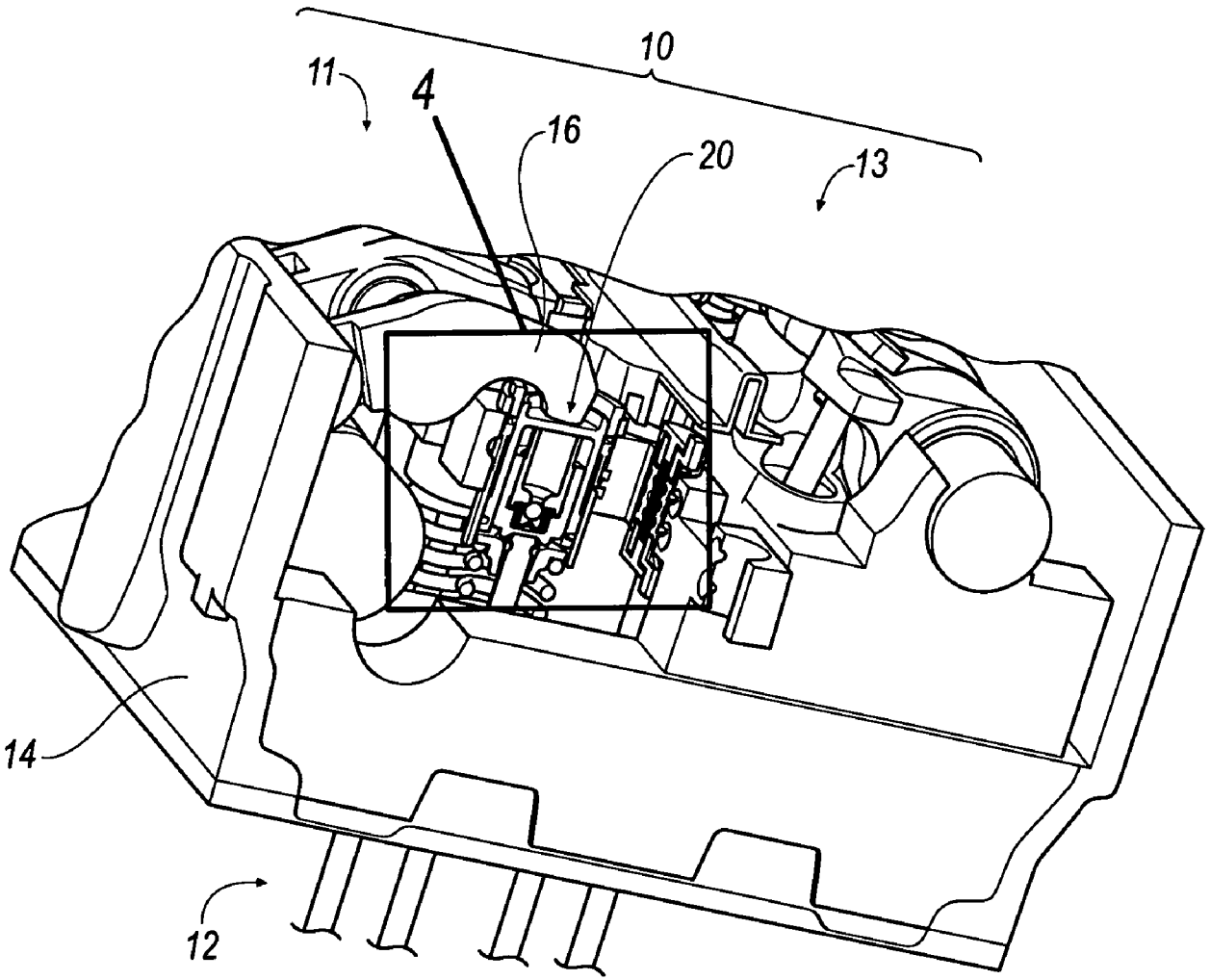
FIG. 2 is a partial cross-sectional perspective view, taken substantially along line 2-2 of FIG. 1.
Figure 7:
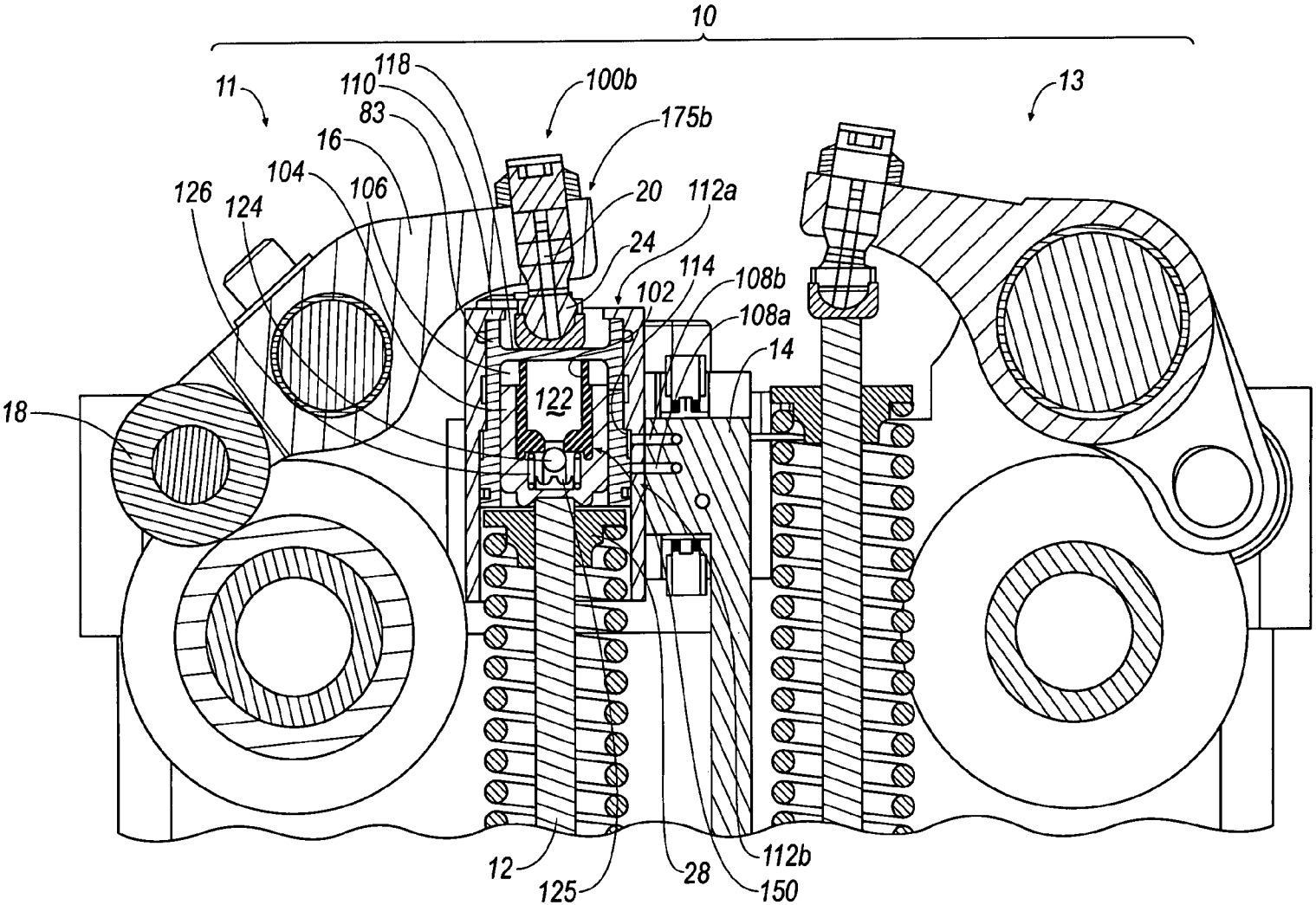
FIG. 7 is a partial cross-sectional view of a valve train and housing according to an embodiment.

According to the embodiment shown in FIGS. 1 and 2, a valve train 10 including a plurality of engine valves 12 is shown in connection with a housing cradle 14. The illustrated valve train 10 includes a plurality of rocker arms 16 and rocker arm rollers 18. An engagement end 20 of the rocker arm 16 may include, for example, a rounded end 22 having a fixed radius (see, e.g., FIGS. 5 and 9), or, alternatively, an adjustment screw 24 (see, e.g., FIG. 7). The embodiment of valve train 10 illustrated in FIGS. 1 and 2 can further be said to have an intake-side 11 and an exhaust-side 13.

Figure 3:
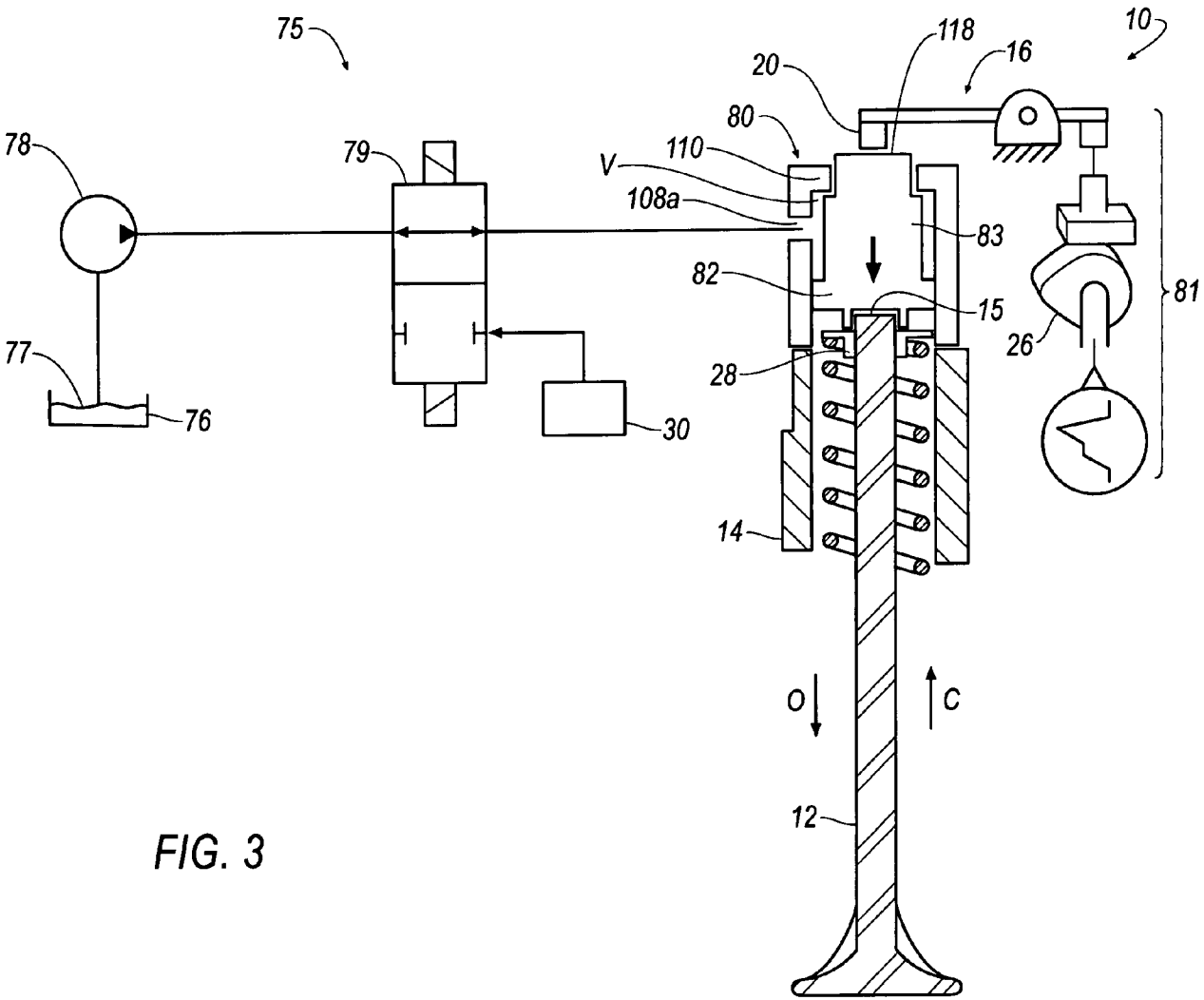
FIG. 3 is a schematic view of an added motion valve system according to an embodiment.
Figure 10:
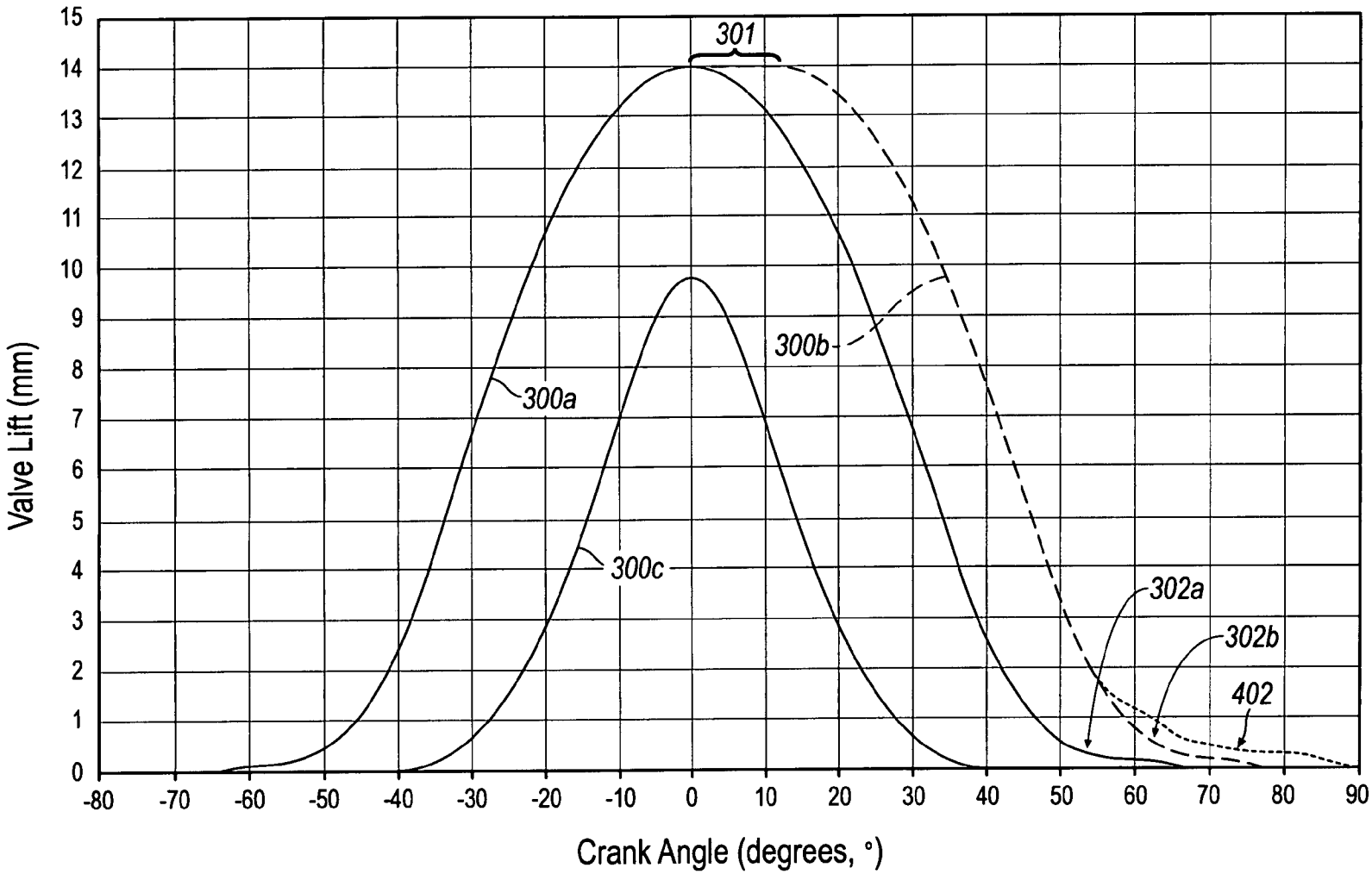
FIG. 10 generally illustrates a cam profile engine valve opening/closing curve, an added motion cam profile curve, and a lost motion cam profile curve.

Referring to FIG. 3, an engine valve 12 and rocker arm 16 of valve train 10 are shown schematically in the form of a hydraulic system 75. The hydraulic system 75 may be, for example, an "added motion"-type valve system that includes a sump 76 with fluid 77, a pump 78, an actuator 79, and an actuator fluid volume or housing 80 for receiving a volume of fluid for providing an added-motion valve curve, which is shown generally at 300*b* in FIG. 10 according to an embodiment. The actuator 79, which may be, for example, a solenoid valve, may be moved to either an open position or a closed position. In an open position, actuator 79 may permit movement of fluid 77 in and out of the actuator fluid housing 80 so that the engine valve 12 is allowed to freely reciprocate within cradle 14 in an opening stoke movement, O, or a closed stoke movement, C.

During an opening stroke, O, a controller 30 may control an actuator 79 to move from an open position/configuration to a closed position/configuration. Movement of the actuator 79 to a closed position can trap a volume, V, of fluid 77 in the actuator fluid housing 80 to lock, or substantially lock, the engine valve 12 during an opening stroke, O for a period of time. The amount of time may be determined or selectively controlled by controller 30. Such an "added motion" movement of valve 12 is generally represented by the curve identified by 300*b*, and a "locked" added motion stroke of the engine valve 12 is shown generally at 301. Thus, for example, when the actuator 79 is closed, fluid 77 can be controllably trapped in the volume, V, within the actuator fluid housing 80 and further movement of valve 12 from a locked or open position to a closed position may be delayed until the actuator 79 is reconfigured from a closed position to an open position.

Figure 4:
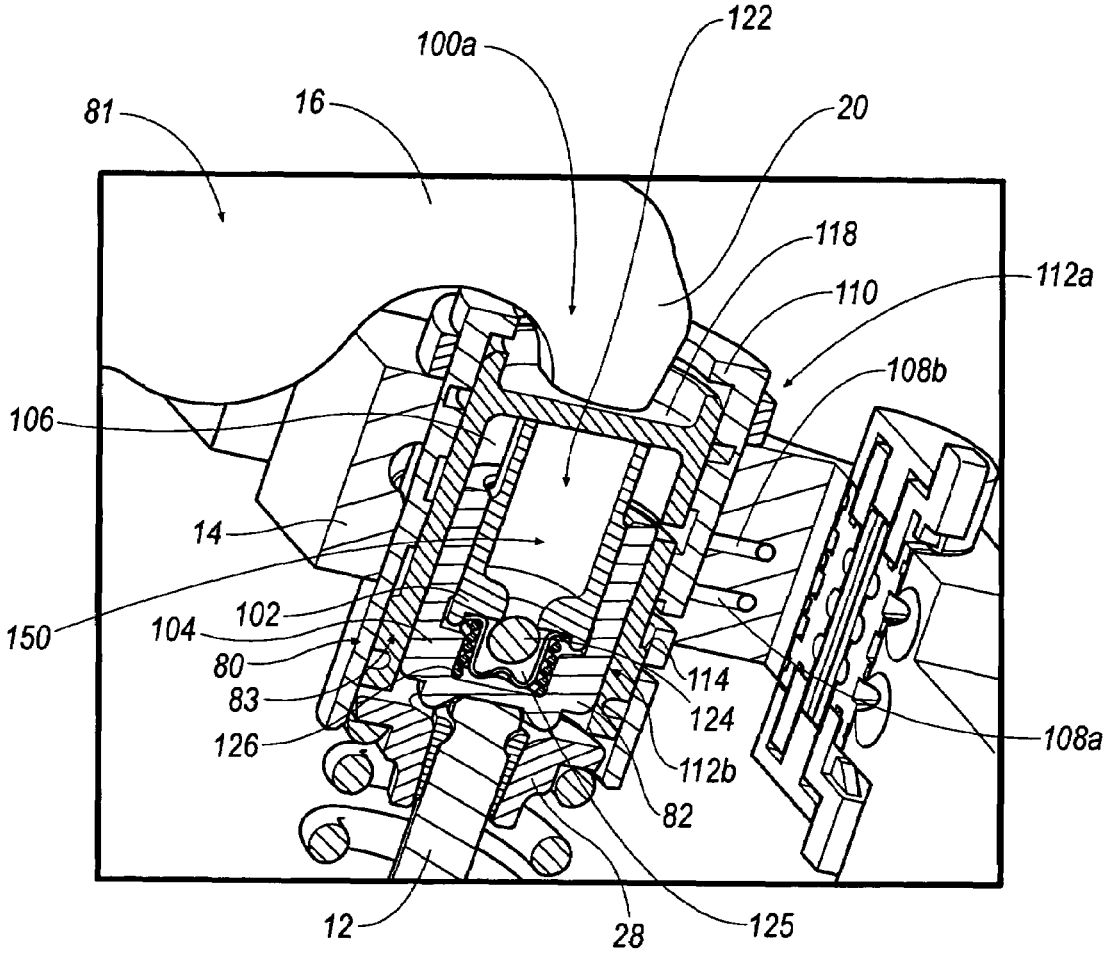
FIG. 4 is an enlarged, cross-sectional view of the encircled region in FIG. 2.

Referring now to FIGS. 3 and 4, disposed in the actuator fluid housing 80 is a plunger 83 that may contact the engagement end 20 of the rocker arm 16. As illustrated, the plunger 83 is generally disposed inside of the actuator fluid housing 80, between an engine valve 12 and the rocker arm 16 of a cam arrangement 81. The cam arrangement 81 may include, for example, the rocker arm 16 and camshaft 26. In accordance with an embodiment, the plunger 83 generally includes a piston portion 82 that may engage, depending on an embodiment, either one of, or both, a retainer 28 and engine valve 12.

According to an embodiment, the volume, V, may be directly disposed between an engine valve actuator (e.g. the cam arrangement 81 and/or the rocker arm 16) and a plunger engagement end 15 of the engine valve 12. Thus, it will be appreciated that actuator fluid housing 80 and volume, V, of the "added motion"-type valve system is non-integral with the engine valve 12.

Figure 8:
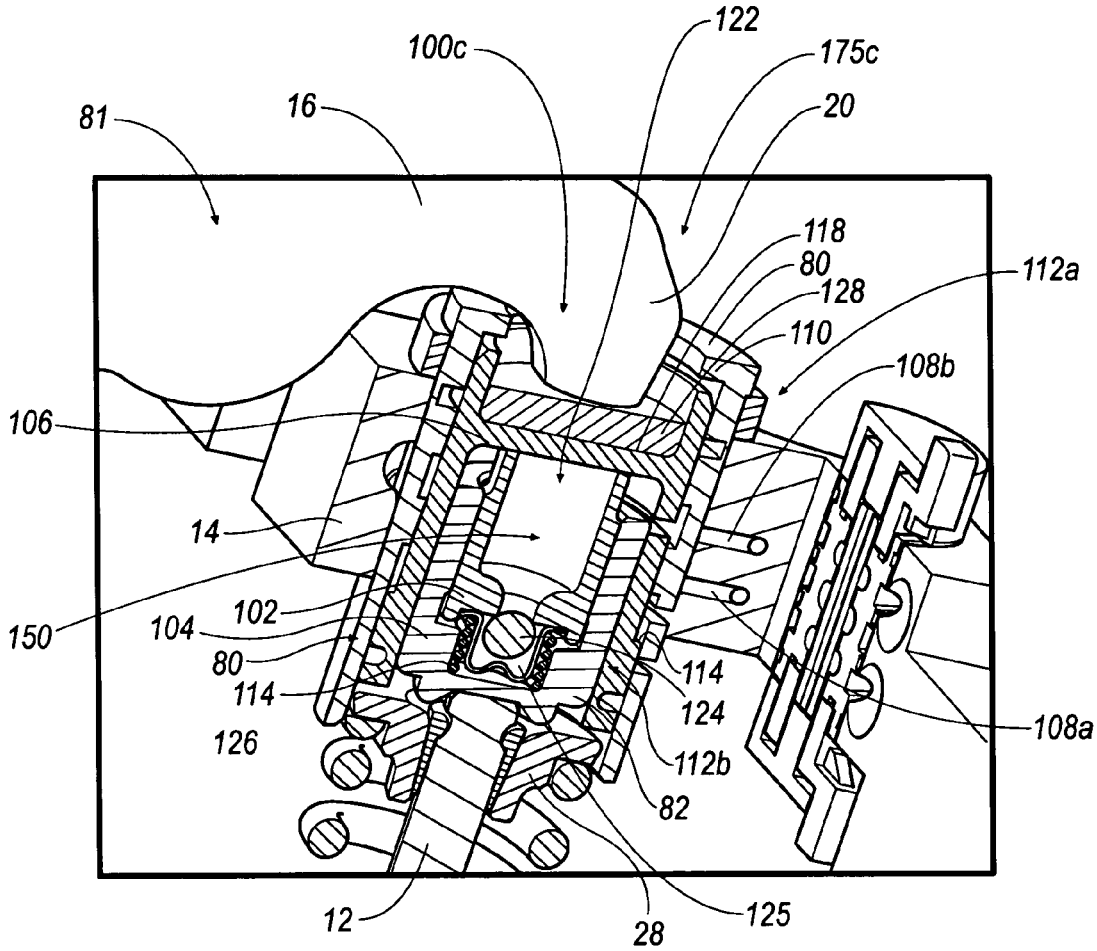
FIG. 8 is an enlarged perspective cross-sectional view of a valve train and housing cradle according to another embodiment.
Figure 9:
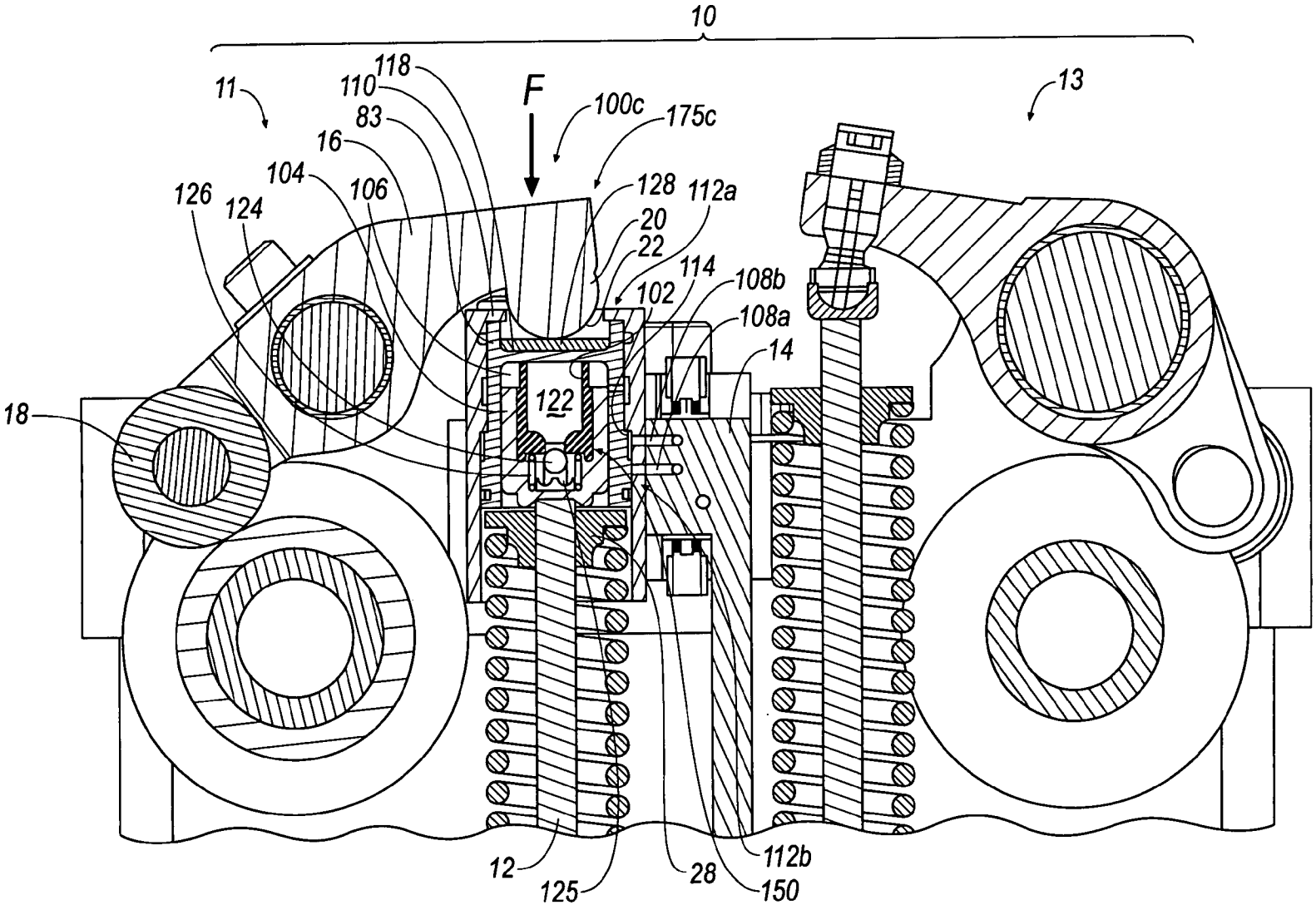
FIG. 9 is a partial cross-sectional view of a valve train and housing of the type shown in FIG. 8.

Referring to embodiments illustrated in FIGS. 4-9, a lash adjuster assembly or arrangement is generally shown at 100*a* (FIGS. 4-6), 100*b* (FIG. 7), 100*c*(FIGS. 8 and 9). In the embodiment illustrated in FIGS. 4-9, the lash adjuster arrangements 100*a*-100*c* include a hydraulic lash adjuster arrangement, or, alternatively, an added motion hydraulic lash adjuster arrangement, which is shown generally at 150. According to an embodiment, the lash adjuster assembly 100*b* of FIG. 7 and the lash adjuster assembly 100*c* of FIGS. 8-9 also include a mechanical lash adjuster arrangement 175*b*, 175*c*, respectively, which are described in greater detail below.

According to an embodiment, the added motion hydraulic lash adjuster arrangement 150 relieves undesirable lash in the valve train 10. Control of such lash is desirable so that the engine valve 12 provides a desired seating ramp 302*a*, 302*b*. Such lash may result from, for example, engine valve seating wear. Alternatively, such lash may arise from, for example, ambient/operating temperature changes about the cradle 14, which may effect expansion and contraction of components (such as, e.g., an engine valve 12).

Figure 5:
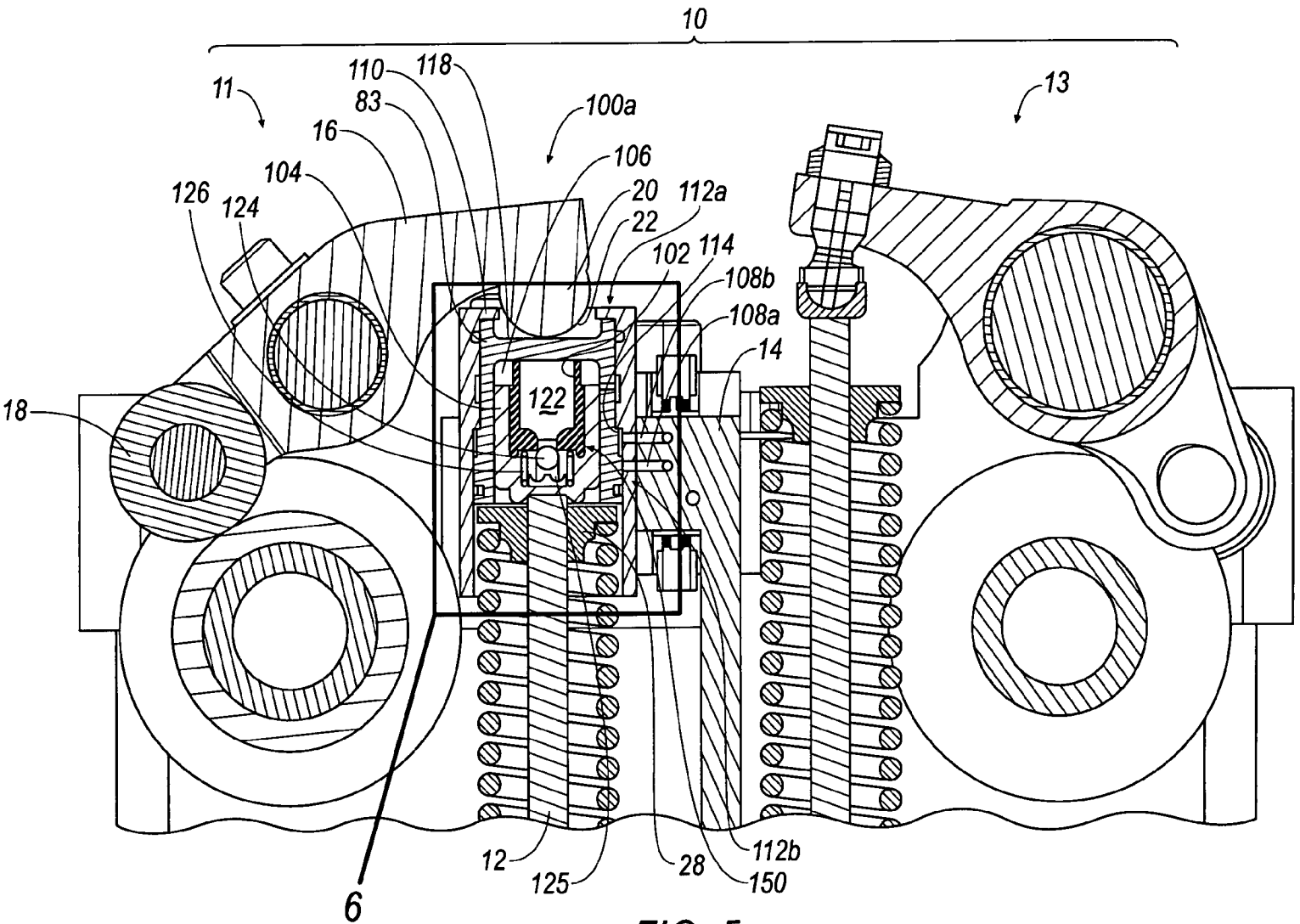
FIG. 5 is a full cross-sectional view, taken along line 2-2 of FIG. 1.
Figure 6:
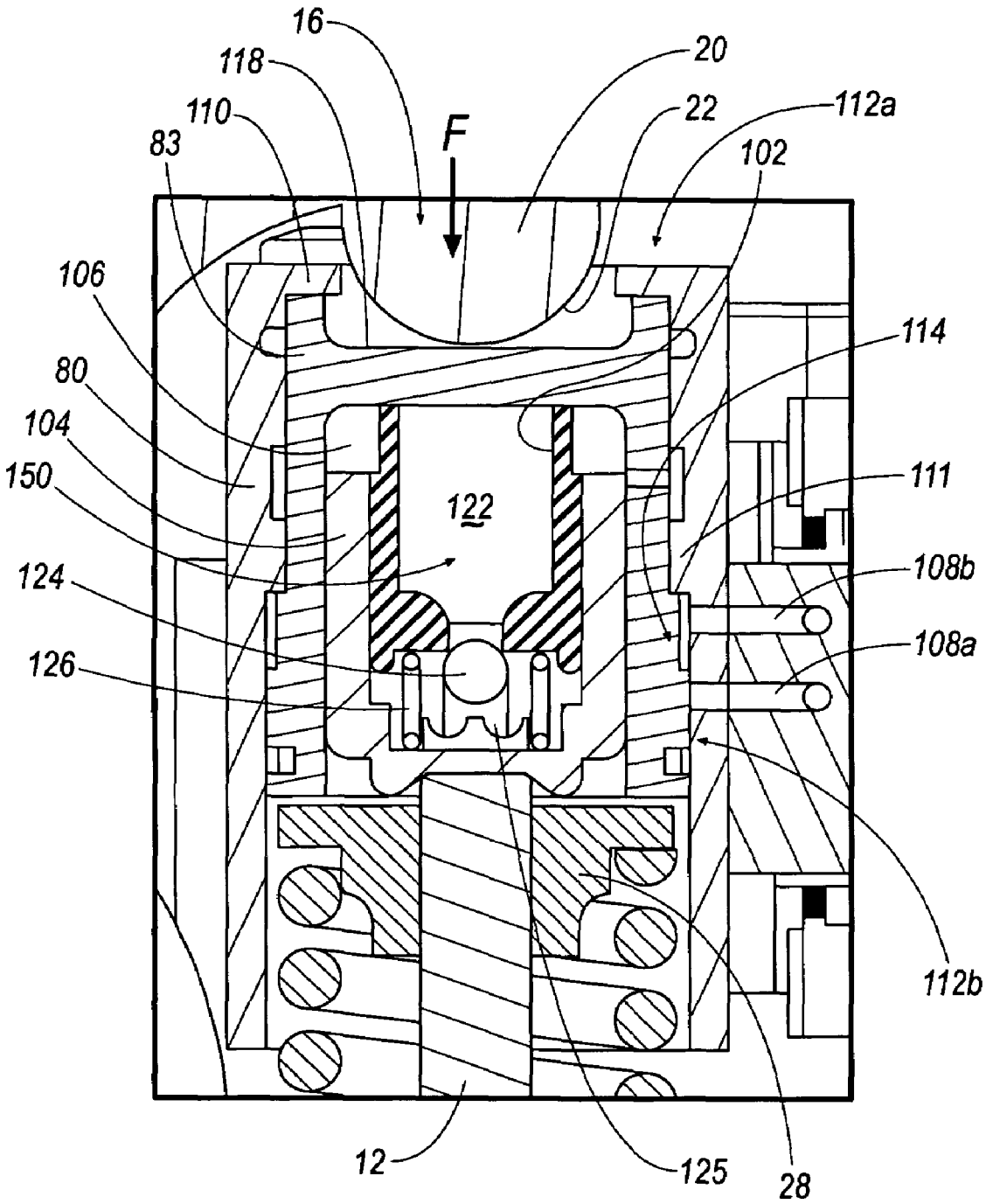
FIG. 6 is enlarged view of the encircled portion of FIG. 5.

Referring to FIGS. 4-6, the added motion hydraulic lash adjuster arrangement 100*a* includes a rocker arm engagement end 20 having a rounded, fixed radius end 22. Alternatively, in the embodiment illustrated in FIGS. 7-9, the lash adjuster assembly or arrangements 100*b*, 100*c* includes any well-known mechanical lash adjuster arrangement 175*b*, 175*c* proximate the rocker arm engagement end 20, which may include, for example, an adjustment screw 24 (FIG. 7) or shim 128 (FIGS. 8-9).

In operation, the adjustment screw 24 or shim 128 can be used to, among other things, control clearances that may occur between the engagement end 20 of the rocker arm 16 and the top portion 118 of the plunger 83. Control of such clearances is desirable so that the desired seating ramp 302*a* is provided. The clearance between the engagement end 20 of the rocker arm 16 and top portion 118 of the plunger 83 may result from, for example, rocker arm tip wear, or, alternatively, ambient/operating temperature changes about the rocker arm to cam, which may effect expansion and contraction of components associated with the lash adjustment assembly arrangement 100*b*, 100*c*.

Referring to FIG. 6, the illustrated added motion hydraulic lash adjuster arrangement 150 generally includes, for example, a lash adjuster piston 102 that is disposed within the a lash adjuster body 104. The lash adjuster body 104 is disposed in a bore 106 formed in the plunger 83. As shown in the illustrated embodiments, the lash adjuster piston 102 and lash adjuster body 104 are arranged between the rocker arm 16 and engine valve 12. With such a configuration, the lash adjustment piston 102 can provide hydraulic lash adjustment of an engine valve 12 when the engine valve 12 is at zero lift. Such configurations can provide advantages beyond conventional, mechanical lash adjustment arrangements that are part of, or, proximate to a rocker arm 16, such as, for example, fixed rocker arm pivots; however, it will be appreciated that the added motion hydraulic lash adjuster arrangement 150 may also operate in cooperation with mechanical lash adjuster assemblies 175*b*, 175*c*, such as that shown in FIGS. 7-9, to further reduce clearances that may exist between the plunger 83 and engagement end 20 of the rocker arm 16. According to an embodiment, the bore 106 of the plunger 83 disposed in the actuator fluid housing 80 is in fluid communication with a supply passage 125 that receives fluid 77 from sump 76.

A main fluid supply passage 108*a* and a valve seating fluid passage 108*b* are also formed in the cradle 14 to permit the supply of fluid 77 from the sump 76 to the plunger 83. The flow of fluid 77 from the main fluid supply passage 108*a* to the plunger 83 is permitted or otherwise controlled by the actuator 79. Such control may, for example, be associated with the "open" or "closed" position/configuration of the actuator 79 as previously described. The valve seating fluid passage 108*b*, however, may be open or exposed at all lifts of the engine valve 12 to provide or set seating velocity for engine valve 12 at various operating temperatures.

In addition, to provide the desired seating 302*a*, 302*b*, a stop 110 may extend from the actuator fluid housing 80. During the opening stoke movement, O, and closing stoke movement, C, the plunger 83 is moved according to the direction of the arrows O, C, corresponding to the opening and closing stokes of the engine valve 12. Accordingly, movement in the direction of the arrows O, C may effect the positioning of the plunger 83 relative the main fluid supply passage 108*a* within the actuator fluid housing 80. As such, the stop 110 fixes an amount of permitted travel of the plunger 83 relative the actuator fluid housing 80 so as to maintain a desired fluid communication (i.e., for example, closing-off a fluid communication with passage 108*a*) with the main fluid supply passage 108*a* to provide the desired seating 302*b* of the added motion curve 300*b*.

As illustrated, the stop 110 may be, for example, integrally formed at a top portion 112*a* of the actuator fluid housing 80 to precisely control fluid porting 108*a*, 108*b* in the lash adjuster system 100*a*, 100*b*, 100*c*. The stop 110, according to an embodiment, may include a radial, circumferential flange that extends toward the engagement end 20 of the rocker arm 16. It will be appreciated that a stop may be located at other positions of the actuator fluid housing 80 relative the positioning of the plunger 83; for example, a stop 111 may extend from the actuator fluid housing 80 proximate a lower portion 112*b* (e.g., a stepped portion 114, as shown) of the plunger 83.

With continued reference to FIG. 6, when the engine valve 12 seats, the plunger 83 contacts the stop 110 and when an engagement end 20 of a rocker arm 16 applies a zero force in the direction of the arrow F to a top portion 118 of the plunger 83, fluid 77 that fills a bore 122 in the lash adjuster piston 102 may be passed through, for example, a check ball 124 in communication or otherwise associated with the lash adjuster piston 102 to provide hydraulic lash adjustment proximate the bottom portion 112*b* of the plunger 83. As illustrated, a lash adjuster spring 126 may be included to at least partially bias the lash adjuster piston 102 and lash adjuster body 104 in generally opposite directions. Accordingly, fluid pressure in the bore 125 in combination with the lash adjuster spring 126 hydraulically pre-loads and rigidities the lash adjuster assembly 100*a*, 100*b*, 100*c* during reciprocation on the engine valve 12.

Although embodiments of the lash adjustment assemblies or arrangements, such as those illustrated, are shown on the intake-side 11 of a valve train 10, it will be appreciated that the lash adjuster assemblies or arrangements are not limited to the intake side 11. For example, it will be appreciated that such lash adjuster assemblies or arrangements may be positioned on an exhaust-side 13 of a valve train 10, for instance, to compensate for valve growth due to temperature changes or valve seating wear. Accordingly, this may eliminate the need for initial valve adjustments after an engine is constructed.

The present invention has been particularly shown and described with reference to the foregoing embodiments, which are merely illustrative of the best mode or modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A hydraulic valve system, comprising:

an engine valve including an engagement end;

an engine valve actuator that causes movement of said engine valve;

a solenoid actuator valve; and an added motion fluid actuator housing having a volume for receiving fluid, wherein said volume is disposed between the engine valve actuator and said engagement end of the engine valve, wherein, when said solenoid valve is moved to an open position, said fluid is permitted to be forced out of said added motion fluid actuator housing during an opening and closing stroke of said engine valve, and, wherein, when said solenoid valve is moved to a closed position, said fluid is trapped in said added motion fluid actuator housing and prevented from being forced out of said added motion fluid actuator housing to prevent a change in lift of said engine valve.

2. The hydraulic valve system according to claim 1, wherein said engine valve actuator comprises a cam arrangement.

3. The hydraulic valve system according to claim 2 further comprising:

a rocker arm disposed between said cam arrangement and said added motion fluid actuator housing; and a plunger disposed between said rocker arm and said engagement end of the engine valve.

4. The hydraulic valve system according to claim 3, wherein said plunger is disposed in said added motion fluid actuator housing.

5. The hydraulic valve system according to claim 4, further comprising:

a cradle, wherein said added motion fluid actuator housing is disposed in said cradle;

a lash adjuster body disposed in said plunger; and a lash adjuster piston disposed in said lash adjuster body.

6. The hydraulic valve system according to claim 1, wherein said fluid trapped in said volume prevents a change in lift of said engine valve for a period of time when the solenoid valve is moved to a closed position.

7. The hydraulic valve system according to claim 1, wherein said volume is non-integral with said engine valve.

8. A lash adjuster assembly for a valve system, comprising:

an added motion actuator fluid housing;

an added motion hydraulic lash adjuster disposed within the added motion actuator fluid housing;

a lash adjuster piston disposed within the a lash adjuster body, wherein the lash adjustment piston provides hydraulic lash adjustment of an engine valve when the engine valve is at zero lift;

a cam arrangement that causes movement of the engine valve;

fluid that moves through a solenoid actuator valve; and a volume defined by the added motion actuator fluid housing for receiving said fluid, wherein, when said solenoid valve is moved to an open position, said fluid is permitted to be forced out of said added motion actuator fluid housing during an opening and closing stroke of said engine valve, and, wherein, when said solenoid valve is moved to a closed position, said fluid is trapped in said added motion actuator fluid housing and prevented from being forced out of said added motion actuator fluid housing to prevent a change in lift of said engine valve.

9. The added-motion hydraulic valve system according to claim 8, wherein said fluid trapped in said volume prevents a change in lift of said engine valve for a period of time when the solenoid valve is moved to a closed position.

10. The added-motion hydraulic valve system according to claim 9 further comprising:

a rocker arm disposed between said cam arrangement and said added motion actuator fluid housing; and a plunger disposed between said rocker arm and said engagement end of the engine valve, wherein the plunger is disposed within said added motion actuator fluid housing.

11. The lash adjuster assembly according to claim 10, wherein the lash adjuster body is disposed in a bore formed in said plunger, wherein the lash adjuster piston and lash adjuster body are arranged between the rocker arm and engine valve.

12. The lash adjuster assembly according to claim 11, wherein the bore is in fluid communication with a supply passage that receives said fluid from a sump.

13. The lash adjuster assembly according to claim 11 further comprising a main fluid supply passage and a valve seating fluid passage formed in a cradle to permit said fluid to be supplied to said volume in the added motion actuator fluid housing, wherein said added motion actuator fluid housing is disposed in said cradle.

14. A lash adjuster assembly for a valve system, comprising:

an added motion actuator fluid housing;

an added motion hydraulic lash adjuster disposed within the added motion actuator fluid housing;

a mechanical lash adjuster actuated by a cam arrangement;

a lash adjuster piston disposed within the a lash adjuster body, wherein the lash adjustment piston provides hydraulic lash adjustment of an engine valve when the engine valve is at zero lift;

a cam arrangement that causes movement of the engine valve;

fluid that moves through a solenoid actuator valve; and a volume defined by the added motion actuator fluid housing for receiving said fluid, wherein, when said solenoid valve is moved to an open position, said fluid is permitted to be forced out of said added motion actuator fluid housing during an opening and closing stroke of said engine valve, and, wherein, when said solenoid valve is moved to a closed position, said fluid is trapped in said added motion actuator fluid housing and prevented from being forced out of said added motion actuator fluid housing to prevent a change in lift of said engine valve.

15. The lash adjuster assembly according to claim 14, wherein the mechanical lash adjuster includes an adjustment screw.

16. The lash adjuster assembly according to claim 14, wherein the mechanical lash adjuster includes a shim.

17. The added-motion hydraulic valve system according to claim 14, , wherein said fluid trapped in said volume prevents a change in lift of said engine valve for a period of time when the solenoid valve is moved to a closed position.

18. The added-motion hydraulic valve system according to claim 17 further comprising:

a rocker arm disposed between said cam arrangement and said added motion actuator fluid housing; and a plunger disposed between said rocker arm and said engagement end of the engine valve, wherein the plunger is disposed within said added motion actuator fluid housing.

19. The lash adjuster assembly according to claim 18, wherein the lash adjuster body is disposed in a bore formed in said plunger, wherein the lash adjuster piston and lash adjuster body are arranged between the rocker arm and engine valve.

20. The lash adjuster assembly according to claim 19, wherein the bore is in fluid communication with a supply passage that receives said fluid from a sump.

21. The lash adjuster assembly according to claim 19 further comprising a main fluid supply passage and a valve seating fluid passage formed in a cradle to permit said fluid to be supplied to said volume in the added motion actuator fluid housing, wherein said added motion actuator fluid housing is disposed in said cradle.

22. The lash adjuster assembly according to claim 21, wherein the hydraulic last adjuster provides controlled fluid flow to the valve seating fluid passage to control a seating ramp of the engine valve, and, wherein a stop of the added motion actuator fluid housing fixes an amount of permitted travel of the plunger to maintain fluid communication with the valve seating fluid passage to control the seating ramp of the engine valve.

23. A hydraulic valve system, comprising:

an actuator valve movable for placement in an open position and closed position;

an engine valve including an engagement end;

an engine valve actuator including a cam profile that provides movement of the engine valve according to a cam profile baseline stroke course; and means for deviating movement of the engine valve during the cam profile baseline stroke course to an added motion stroke course, wherein the means is disposed between the engine valve actuator and the engagement end of the engine valve, wherein the deviating movement includes a transition from the cam profile baseline stroke course to the added motion stroke course, wherein the transition includes a holding pattern of a lift position of the engine valve for a period of time.

24. The hydraulic valve system according to claim 23, wherein the cam profile baseline stroke course includes a continuously changing lift position of the engine valve according to the cam profile that provides movement of the engine valve.

25. The hydraulic valve system according to claim 24, wherein the means includes, an actuator fluid housing disposed in a housing cradle.

26. The hydraulic valve system according to claim 25, further comprising:

a sump including fluid, wherein the fluid moves through the actuator valve, wherein the actuator fluid housing defines a volume for receiving said fluid from said sump, wherein said volume is non-integral with said engine valve.

27. The hydraulic valve system according to claim 26, wherein, when said actuator valve is moved to said open position, said fluid is permitted to be forced out of said volume during an opening and closing stroke of said engine valve as defined by the cam profile baseline stroke course, and, wherein, when said solenoid valve is moved to said closed position, said fluid is trapped in said volume and prevented from being forced out of said volume.

28. The hydraulic valve system according to claim 25, further comprising:

a plunger disposed within said actuator fluid housing; and a hydraulic lash adjuster body disposed within said plunger.

29. The hydraulic valve system according to claim 28, wherein said hydraulic lash adjuster includes, a lash adjuster piston disposed within the lash adjuster body, wherein the lash adjustment piston provides hydraulic lash adjustment of the engine valve when the engine valve is at zero lift.

* * * * *